US009057164B2

(12) United States Patent
Kunkel

(10) Patent No.: US 9,057,164 B2
(45) Date of Patent: Jun. 16, 2015

(54) AREA DELINEATOR

(76) Inventor: Chad Kunkel, Jacksonville, FL (US)

( * ) Notice: Subject to any disclaimer, the term of this patent is extended or adjusted under 35 U.S.C. 154(b) by 0 days.

(21) Appl. No.: 13/413,730

(22) Filed: Mar. 7, 2012

(65) Prior Publication Data

US 2013/0236247 A1 Sep. 12, 2013

(51) Int. Cl.
*E01F 13/02* (2006.01)
*E01F 13/04* (2006.01)

(52) U.S. Cl.
CPC ..... *E01F 13/028* (2013.01)

(58) Field of Classification Search
CPC ..... E01F 13/028; E01F 13/04
USPC ..... 404/6, 9, 10, 12; 40/514, 515; 160/24; 116/63 R, 63 P, 63 C; 256/45
See application file for complete search history.

(56) References Cited

U.S. PATENT DOCUMENTS 4,317,617 A * 3/1982 Charlton ..... 359/553
4,418,861 A * 12/1983 McFarland et al. ..... 229/108.1
6,115,951 A * 9/2000 Jing et al. ..... 40/610
6,142,701 A * 11/2000 Falcon ..... 404/6
6,656,514 B1 * 12/2003 Tubbs ..... 426/115
6,969,050 B1 * 11/2005 Loebner ..... 256/1
6,971,329 B1 * 12/2005 Stewart ..... 116/63 C
6,981,817 B2 * 1/2006 Braverman ..... 404/9
7,538,688 B1 * 5/2009 Stewart ..... 340/908
2002/0073912 A1 * 6/2002 Kuo ..... 116/63 P
2003/0033742 A1 * 2/2003 Perelli et al. ..... 40/606
2005/0082294 A1 * 4/2005 Ceschi ..... 220/495.07
2006/0000739 A1 * 1/2006 Kadish ..... 206/494
2009/0226252 A1 * 9/2009 Field ..... 404/6

* cited by examiner

*Primary Examiner* — Abigail A Risic
(74) *Attorney, Agent, or Firm* — Adrienne Love

(57) ABSTRACT

An area delineating device is disclosed for creating a temporary border or barrier between two or more points. The delineating device has a base, a hollow vertical member, and an exit opening in the vertical member. A series of flaps, preferably rubber, are located on the bottom of the base and facilitate access to the base cavity in which is housed a reel of disposable partitioning material, such as caution tape or police tape. The disposable partitioning material threads up from the base cavity, through the base channel and into the vertical cavity. The disposable partition material then exits the vertical cavity via the exit opening at the top of the delineating device. A series of lineal windows can be present in the vertical member.

18 Claims, 11 Drawing Sheets

AREA DELINEATOR

CROSS-REFERENCES TO RELATED APPLICATIONS

Not Applicable.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of devices made to establish a temporary physical border or barrier between two or more points or locations. More specifically, this invention comprises a portable area delineating device capable of housing and dispensing reeled tape.

2. Description of the Related Art

Temporary physical borders or barriers are employed in a number of situations. They can be employed to mark-off a hazardous area or crime scene, divert the flow of vehicular or pedestrian traffic, or simply to create multiple spaces out of one larger space. Such temporary borders are typically used by construction crews, military and law enforcement, utility and sanitation crews, and even civilians.

Previously, there were several ways in which such temporary borders or barriers could be created. First, a series of stand-alone markers could be used, such as traffic cones or pylons. However, as the cones are not physically connected, the border or barrier that they create is only imaginary, and the markers could be easily knocked down or blown over. Second, poles or markers connected to partition rope or material that can be independently attached to the poles could be used. However, with that method, the permanent partition material must be stored and transported separately. Third, poles or markers containing extendable and retractable partition material within the top portion of the pole or marker could be used; however, when the partition material becomes damaged or soiled, the entire pole or markers must be replaced. Additionally, these poles or markers are often unstable. Fourth, disposable partition material, such as "caution tape," could be used. Such tape typically comes on a reel or spool and can create a temporary border by tying each end of the tape to an object near each point. This can be cumbersome to transport and is not easily and efficiently dispensed. Instead the disposable tape is threaded through several cones or poles and the remainder of the partition material roll must be stored or set on the ground where it could be damaged. Finally, cones that dispense disposable tape from the top of the cone can be used. However, as such cones house the tape at the top, they are unstable and can easily be knocked down or blown over. Further, they are inefficient to use, store and transport.

Therefore, what is needed is a temporary border or barrier system that can be easily stored and transported, that uses disposable partition material that can be easily replaced, and that is stable enough withstand weather conditions or being bumped into by vehicular or pedestrian traffic. The present invention achieves this objective, as well as others that are explained in the following description.

BRIEF SUMMARY OF THE INVENTION

The present invention comprises a temporary area delineating device for creating a temporary border or barrier between two or more points. The delineating device generally comprises a base, a hollow vertical member, and an exit opening in the vertical member. The base is preferably made of a heavy material, such as rubber. Flaps, preferably rubber, are located on the bottom of the base and facilitate access to the base cavity in which is housed a reel of disposable partitioning material, such as caution tape or police tape. The disposable partitioning material threads up from the base cavity, through the base channel and into the vertical cavity. The disposable partition material then exits the vertical cavity via the exit opening at the top of the delineating device.

When the reel of partition material in the base cavity is exhausted, a user can pull out the empty reel through the flaps in the base and replace it with a full reel in a similar fashion. The flaps then secure the full partitioning material reel inside the base cavity. The partitioning material being housed in the base of the delineating device adds to the stability of the invention, enabling it to remain in place even when hit by traffic or when under environmental stress. Then, when the need for the temporary area delineation abates, the dispensed partition material can be cut from the delineating device and discarded.

REFERENCE NUMERALS IN THE DRAWINGS

| | | | |
|---|---|---|---|
| 10 | delineating device | 12 | vertical member |
| 14 | base | 16 | exit opening |
| 18 | vertical cavity | 20 | base cavity |
| 22 | flaps | 24 | base channel |
| 26 | partition material | 28 | partition material reel |
| 30 | lineal window | 32 | top opening |
| 34 | brake | 36 | bottom portion |

DETAILED DESCRIPTION OF THE INVENTION

Figure 1:
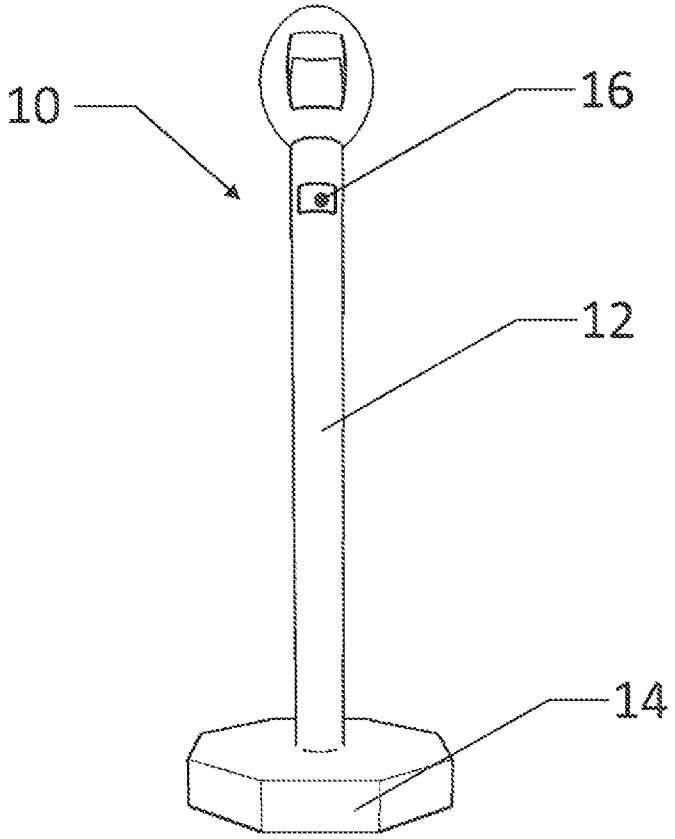
FIG. 1 is a perspective view, showing the exterior of the present invention.
Figure 2:
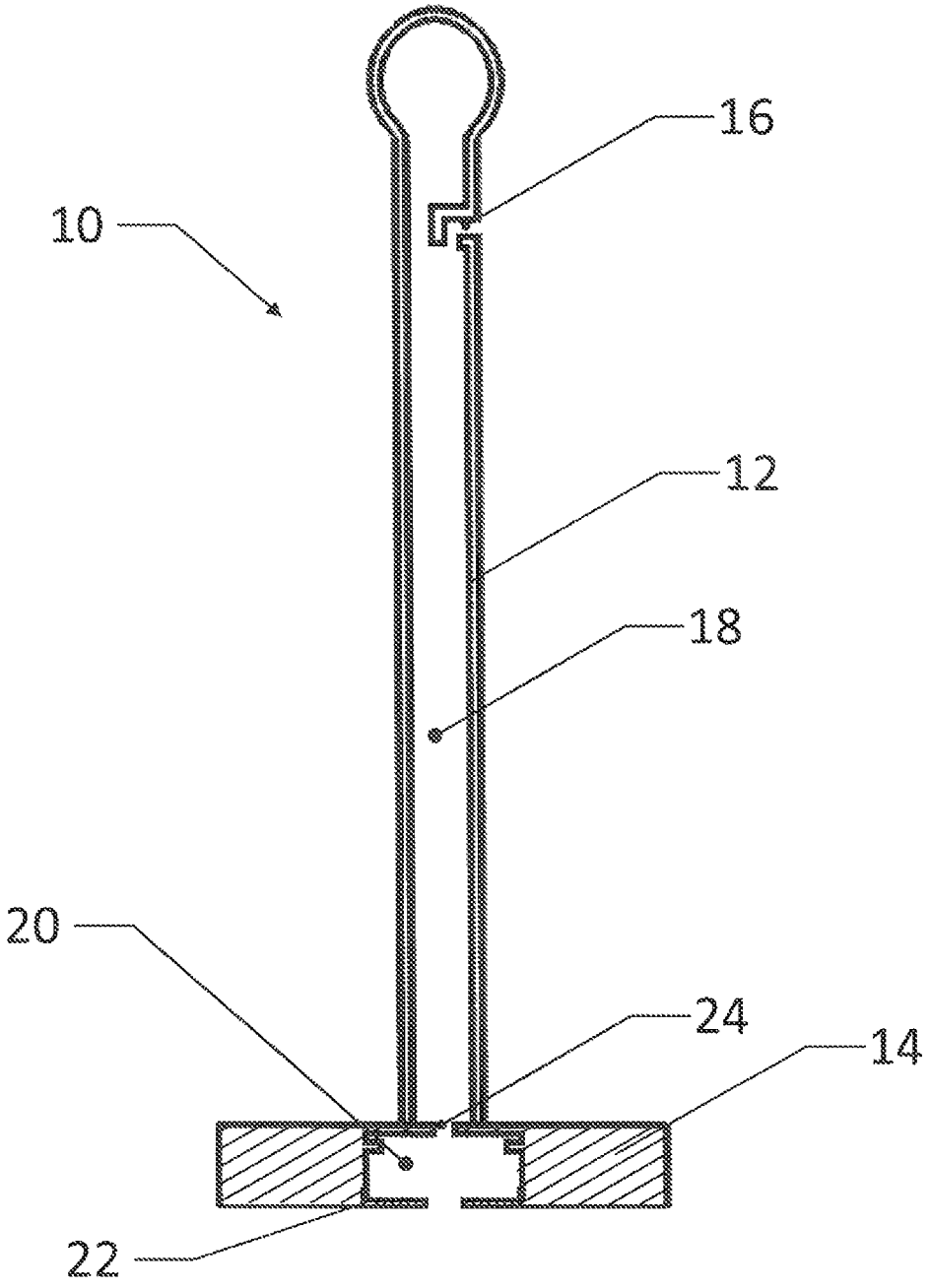
FIG. 2 is a cross-section view, showing the preferred embodiment of the interior of the present invention.

FIG. 1 illustrates the exterior of the present invention in the preferred embodiment. The delineating device comprises vertical member 12 attached to base 14. Vertical member 12 further comprises exit opening 16 and vertical cavity 18, as shown in FIG. 2. In the preferred embodiment, vertical member 12 is made of a hollow rigid material, such as plastic or metal, and is in the shape of a pole, cone, or rod. Base 14, in the preferred embodiment, is made of a heavy weight material, such as rubber, which is capable of creating traction when placed on a road or floor and is capable of withstanding impact from vehicles and pedestrians as well as environmental stress. Base 14 is preferably in the shape of a polygon and holds vertical member 12 upright. As shown in FIG. 2, base 14 comprises base cavity 20, base channel 24, and flaps 22.

Figure 3:
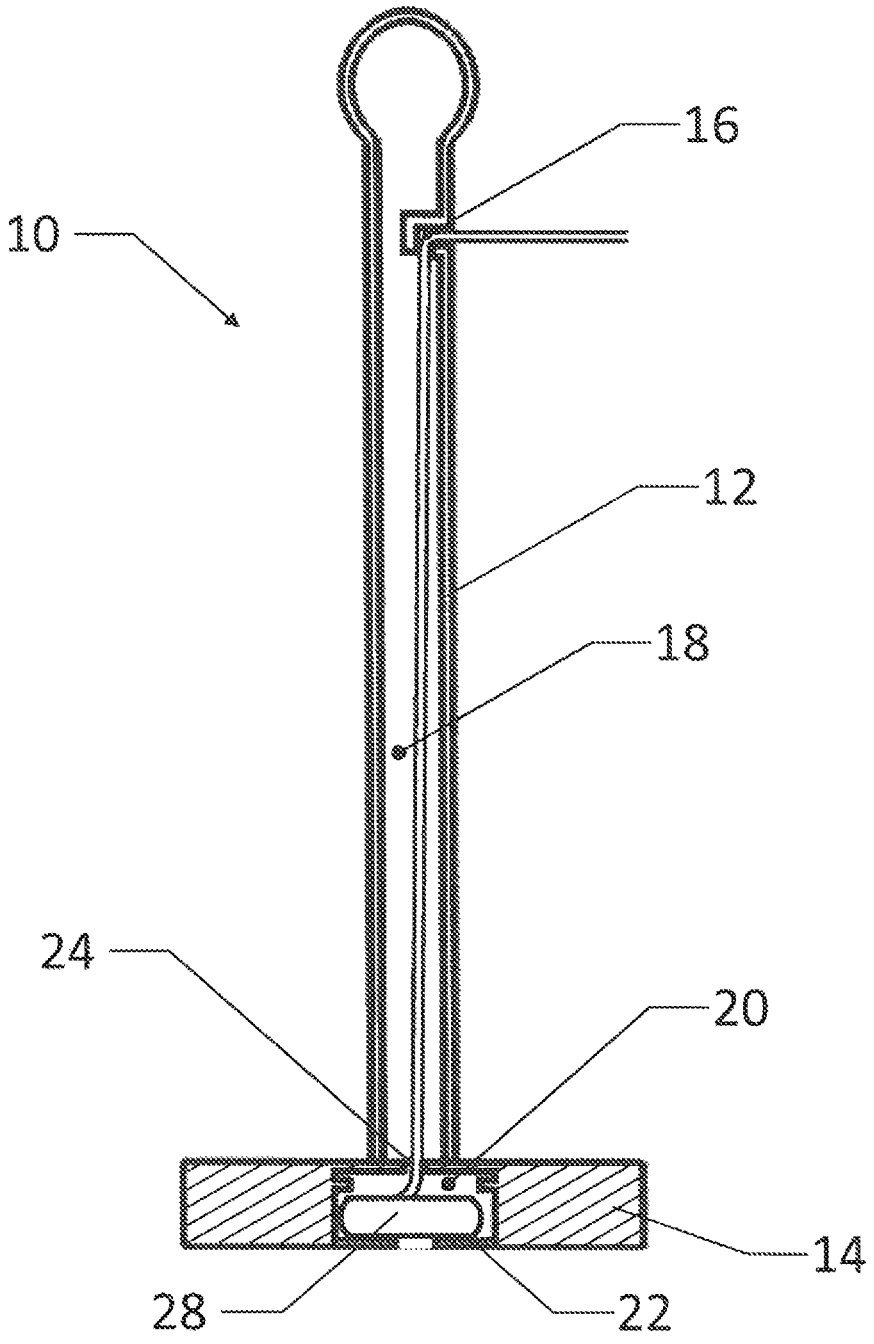
FIG. 3 is a cross-section view, showing the preferred embodiment of the present invention housing and dispensing partition material.
Figure 4:
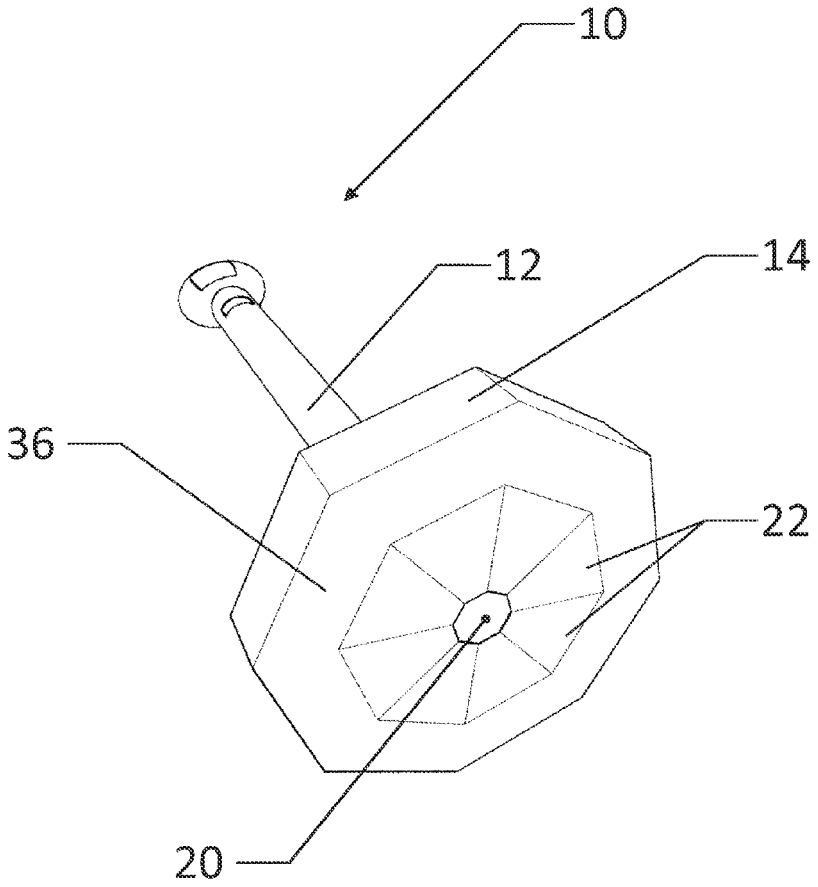
FIG. 4 is a perspective view, showing the preferred embodiment of the present invention from beneath the base.
Figure 5:
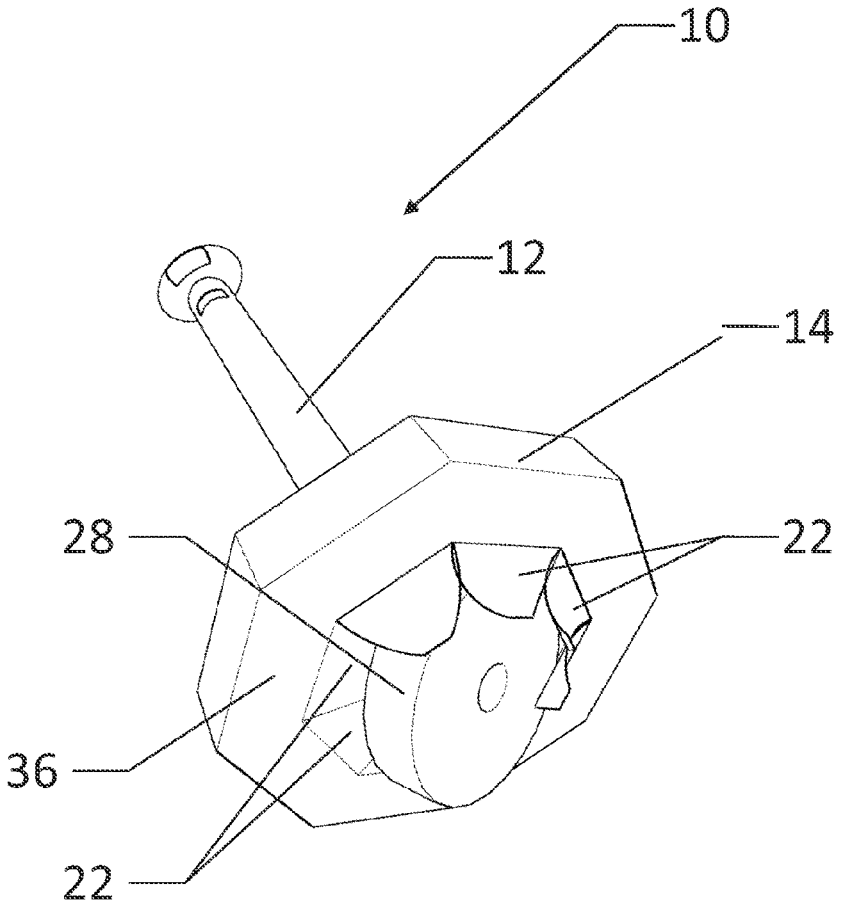
FIG. 5 is a perspective view, showing the preferred embodiment of the present invention from beneath the base with partition material being loaded into the invention.

As illustrated in FIG. 3, base cavity 20 houses partition material reel 28. Flaps 22, having a closed and open position, as shown in FIG. 4 and FIG. 5 respectively, hold partition material reel 28 inside base cavity 20. In FIG. 3, partition material 26, unspools from partition material reel 28, threads up through base channel 24, through vertical member 12, via vertical cavity 18, and out through exit opening 16. Partition material 26 is any light, flexible material that can be discarded after use, such as plastic caution tape or police tape, which is capable of being wrapped on a spool or reel.

Figure 6:
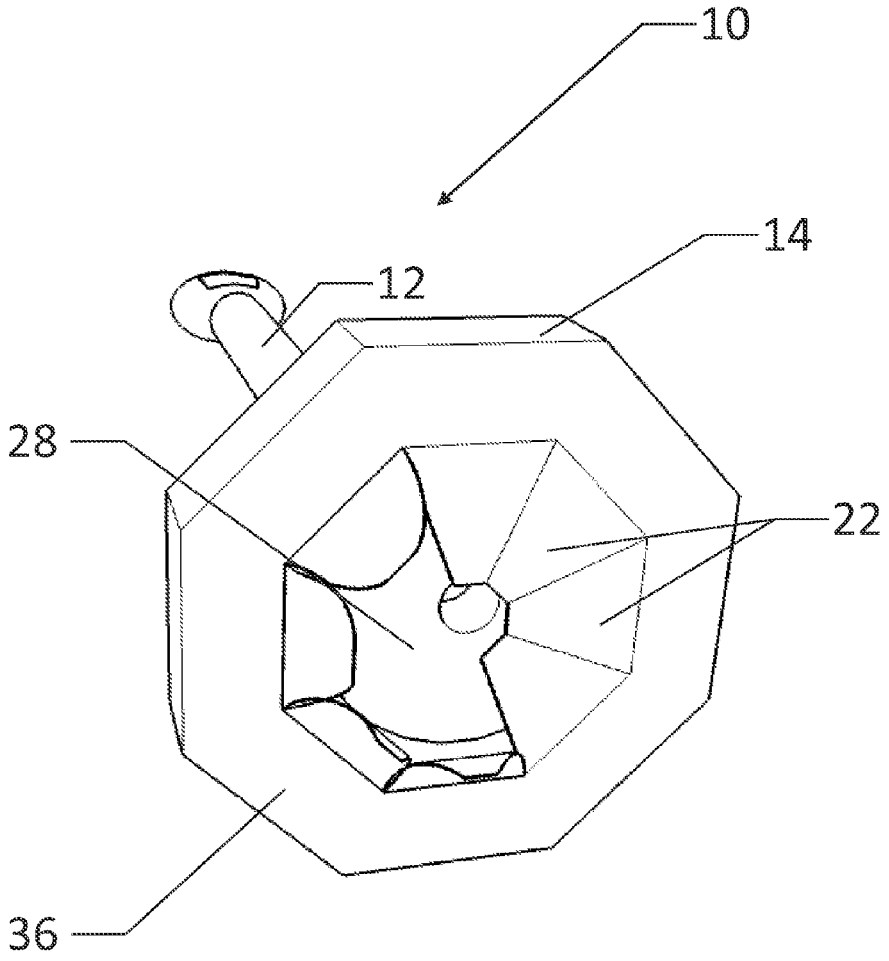
FIG. 6 is a perspective view, showing the preferred embodiment of the present invention from beneath the base with partition material nearly loaded into the base cavity.

FIG. 4 illustrates a view from beneath delineating device 10. A series of abutting flaps 22, shown here in a closed position, attach to the bottom portion 36 of base 14. In the preferred embodiment, flaps 22 almost entirely enclose base cavity 20. As shown in FIG. 5, flaps 22 open to allow a user to insert a full partition material reel 28. As partition material reel 28 is inserted into base 14, flaps 22 close around partition material reel 28, as illustrated in FIG. 6, until they are in the closed position and almost entirely enclose partition material reel 28 inside base cavity 20, as shown in FIG. 4. When partition material reel 28 is empty, the empty reel can be removed in a similar manner. In the preferred embodiment, flaps 22 are made of a thick, malleable material, such as thick rubber, that is capable of bending back to facilitate the insertion and removal, of partition material reel 28, as shown in FIG. 5 and FIG. 6, but that can return to its original shape to hold partition material reel 28 inside base when in the closed position, as shown partially in FIG. 6 and in FIG. 4.

Figure 7:
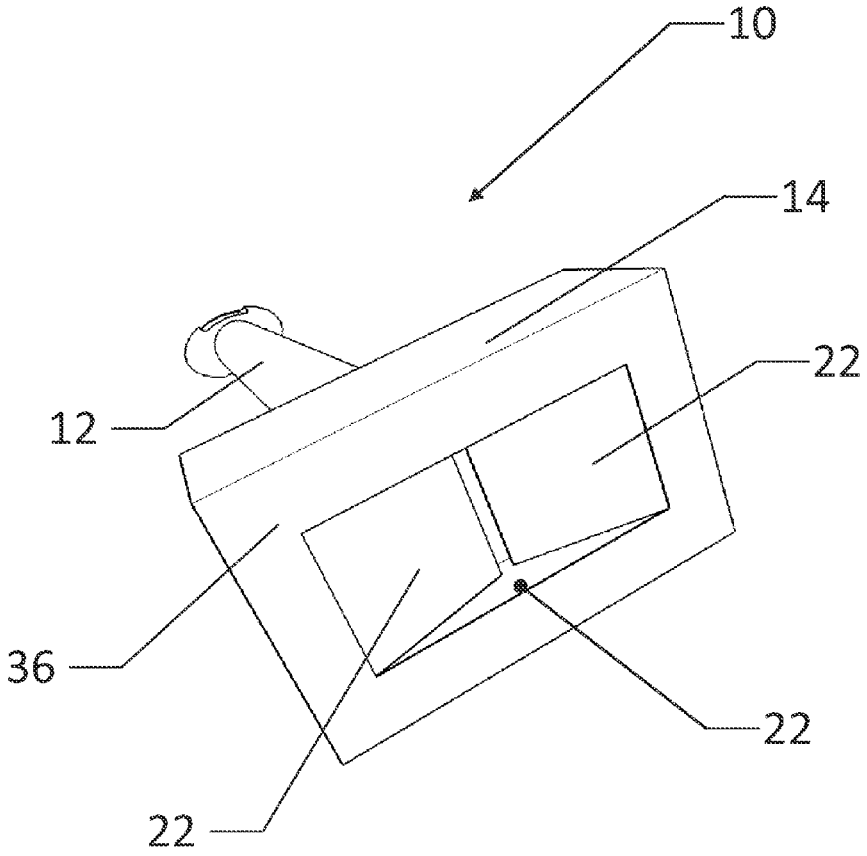
FIG. 7 is a perspective view, showing an alternate embodiment of the base of the present invention.

FIG. 7 shows a view from beneath delineating device 10 in an alternate embodiment of base 14. In this alternate embodiment, base 14 is rectangular in shape and has two flaps 22, shown in a partially open position.

Figure 8:
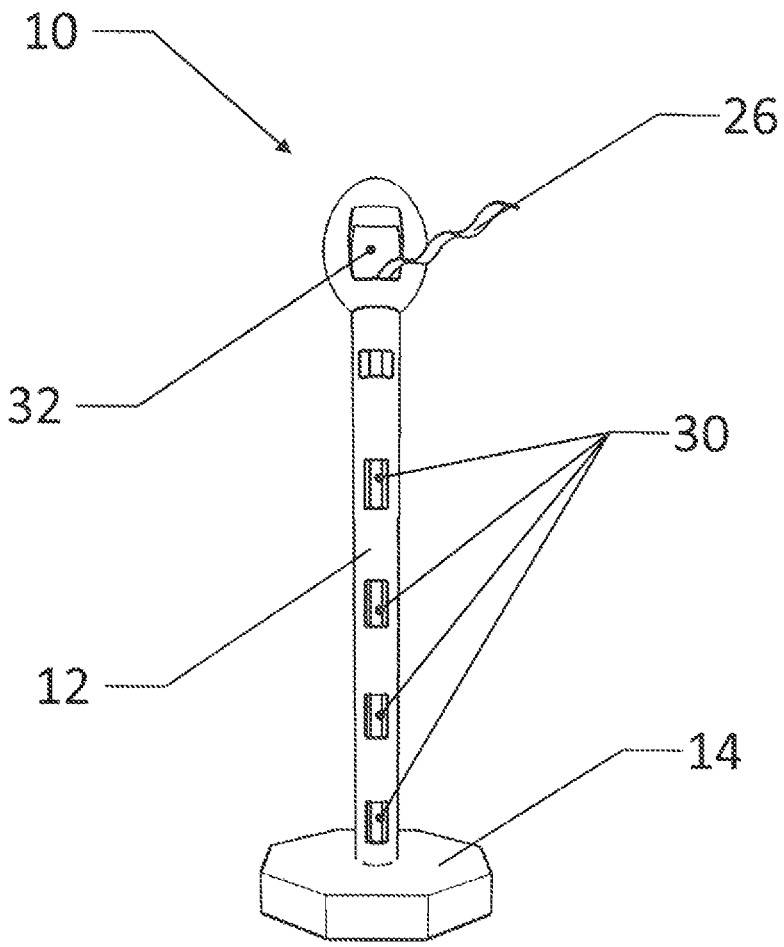
FIG. 8 is a perspective view, showing an alternate embodiment of the present invention
Figure 11:
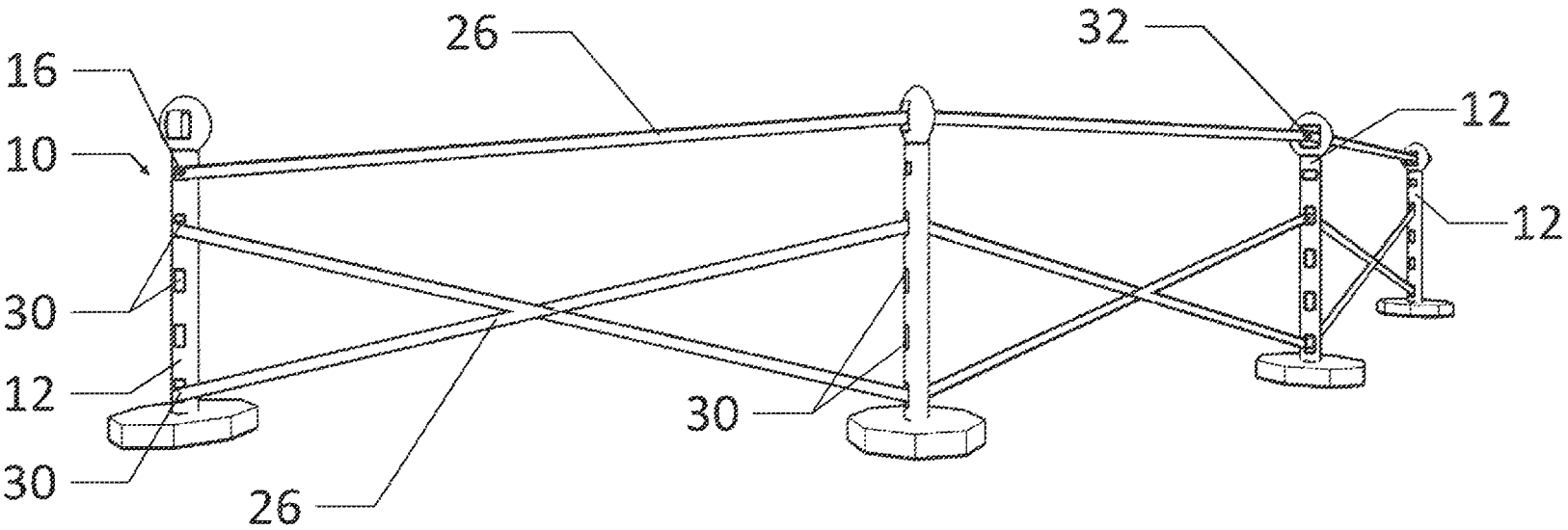
FIG. 11 is a perspective view, showing a use of an alternate embodiment of the present invention.

FIG. 8 is a perspective view of delineating device 10 showing an alternate embodiment of vertical member 12. In this alternate embodiment, vertical member 12 further comprises a row of lineal windows 30 advancing up the side of vertical member 12. When a partition material 26 is inserted into base 14, a user can grasp partition material 26 through each of the successive lineal windows 30 from base 14 upwards to easily thread partition material 26 up through vertical member 12. This alternate embodiment also shows partition material 26 exiting vertical member 26 via top opening 32 as opposed to an exit point on the side of vertical member 12. Thus, exit opening is defined as top opening 32 in the alternate embodiment. As further illustrated in FIG. 11, lineal windows 30 can be used to create a different series of partition patterns from partition material 26. This is accomplished by extending partition material 26 from a lineal window 30 on one vertical member 12 to a lineal window 30 on a proximate vertical member 12. The partition material 26 can be threaded through the lineal windows 30 in any manner that is desirable to the user, in order to accomplish a more secure delineation.

Figure 9:
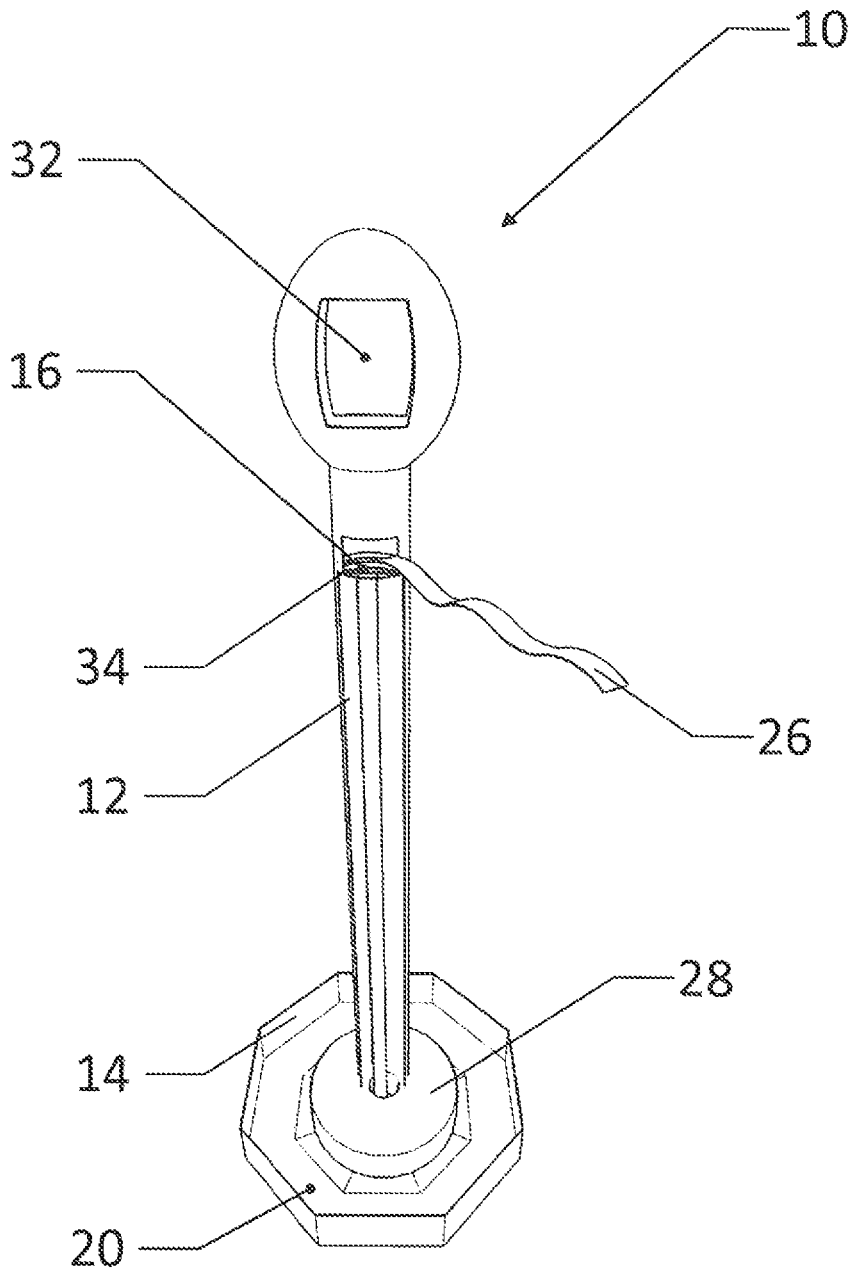
FIG. 9 is a perspective view, showing an alternate embodiment of the present invention.

FIG. 9 is a perspective view of an alternate embodiment of delineating device 10 that further comprises a brake 34 located proximate to exit opening. Brake 34 is made up of a moveable ring through which partition material 26 can be threaded. Brake 34 prevents partition material 26 from slipping back down through vertical member 12 through frictional engagement by pinching down on partition material 26 as it exits vertical member 12 via exit opening 16. Alternatively, brake 34 could be located proximate to top opening 32 to perform the same function in the alternative embodiment illustrated in FIG. 8 in which partition material 26 exits vertical member 12 via top opening 32.

Figure 10:
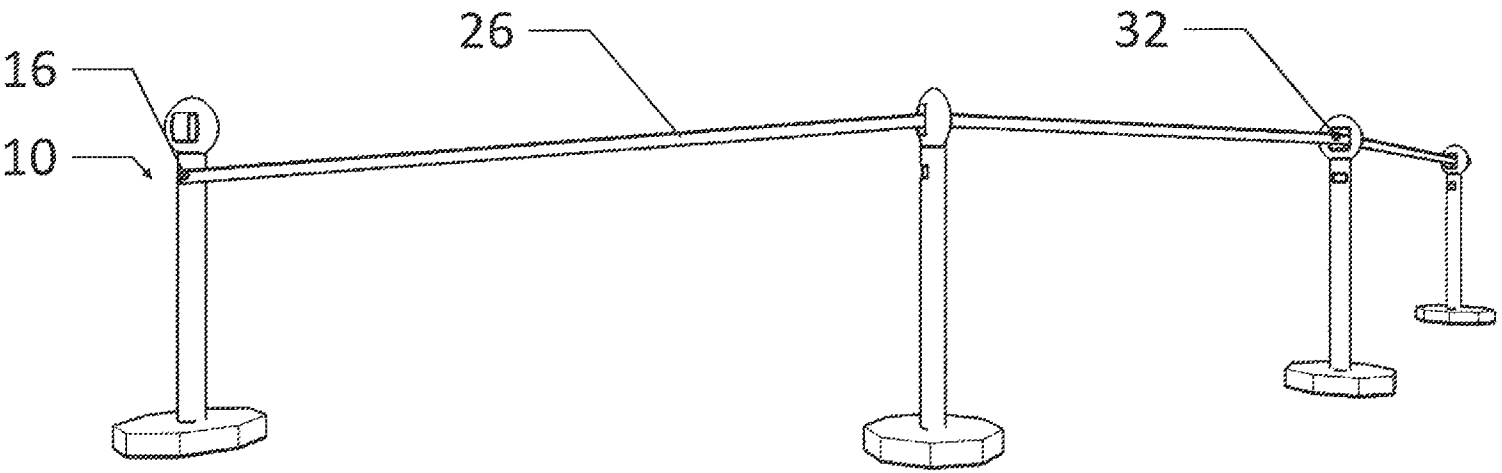
FIG. 10 is a perspective view, showing a series of the preferred embodiment of the present invention with disposable partition material, dispensed.

FIG. 10 shows a multiplicity of delineating devices 10 being used in a series to create a temporary barrier. Partition material 26 is dispensed from the first delineating device 10 via the exit opening 16. It can then be threaded through top opening 32 of the next delineating device in order to create a larger temporary delineated area. Alternatively, after being dispensed via exit opening 16 from the first delineating device 10, partition material 26 could also be affixed or tied to any other existing device or object, such as a traffic cone, lamppost or support beam.

The preceding description contains significant detail regarding the novel aspects of the present invention. It should not be construed, however, as limiting the scope of the invention but rather as providing illustrations of the preferred embodiments of the invention. As an example, the base 14 could be any number of different shapes. Additionally, exit opening 16 could be located at the top of the vertical member 12. Thus, the scope of the invention should be fixed by the following claims, rather than by the examples given.

The invention claimed is:

1. A delineating device used to dispense an amount of partition material on a partition material reel, comprising:

a. a vertical member, having:
   i. a vertical cavity; and
   ii. an exit opening;

b. a base attached to said vertical member, having a base cavity, base channel, a bottom portion and a series of flaps;

c. wherein said partition material reel is capable of being inserted into said base cavity such that said partition material can be threaded through said base channel into said vertical cavity and out said exit opening;

d. wherein said partition material is depleted;

e. wherein when said partition material is depleted said partition material reel is capable of being removed through said series of flaps attached to said bottom portion of said base by pulling said partition material reel through said series of flaps;

f. wherein said depleted partition material reel is capable of being replaced with a second partition material reel having partition material by pushing said second partition material reel through said series of flaps into said base cavity such that said partition material is accessible through said vertical member; and g. wherein said series of flaps enclose said partition material reel within said base cavity such that said partition material can enter said vertical cavity.

2. The delineating device of claim 1, further comprising a series of flaps each having a first end attached to said bottom portion of said base and a plurality of disconnected sides.

3. The delineating device of claim 1, wherein said vertical member further comprises a series of lineal windows, wherein said lineal windows are configured to allow said partition material to extend from said delineating device at multiple points along said vertical member.

4. The delineating device of claim 1, further comprising a brake within said vertical member such that said brake holds said partition material in place.

5. The delineating device of claim 1, wherein said base is made of rubber.

6. The delineating device of claim 1, wherein said exit opening is a top opening on said vertical cavity.

7. The delineating device of claim 2, wherein said series of flaps have an open position and a closed position.

8. The delineating device of claim 7, wherein said partition material can be inserted into said base cavity when said series of flaps are in said open position.

9. The delineating device of claim 1, wherein said base is a polygon shape.

10. A delineating device used to dispense an amount of partition material on a partition material reel, comprising:

a. a vertical member, having:

i. a vertical cavity; and ii. an exit opening;

b. a base attached to said vertical member, having a base cavity, base channel and a bottom portion;

c. a series of flaps, having a first end and a plurality of disconnected sides, wherein said first end is attached to said bottom portion of said base;

d. wherein said series of flaps have an open position and a dosed position;

e. wherein said partition material is depleted from said partition material reel;

f. wherein said series of flaps hold said partition material reel within said base cavity in said closed position such that said partition material is capable of being threaded into said vertical member;

g. wherein said partition material reel is housed such that said partition material reel is accessible within said base cavity until said partition material is depleted; and h. wherein when said partition material is depleted said partition material reel is capable of being removed and replaced through said bottom portion of said base cavity by pulling said partition material reel through said series of flaps.

11. The delineating device of claim 10, further comprising a base channel in said base which leads from said base cavity into said vertical cavity.

12. The delineating device of claim 11, wherein said partition material is threaded from said base cavity through said base channel into said vertical cavity and out of said exit opening.

13. The delineating device of claim 10, wherein said base is made of rubber.

14. The delineating device of claim 10, wherein said series of flaps are made of rubber.

15. The delineating device of claim 10, wherein said vertical member further comprises a series of lineal windows.

16. The delineating device of claim 12, further comprising a brake within said vertical member such that said brake holds said partition material in place.

17. The delineating device of claim 10, wherein said exit opening is a top opening on said vertical cavity.

18. The delineating device of claim 10, wherein said base is a polygon shape.

* * * * *